United States Patent [19]

Gilfaut et al.

[11] Patent Number: 4,714,052

[45] Date of Patent: Dec. 22, 1987

[54] INDUSTRIAL GAS OPERATED LIQUID HEATER

[75] Inventors: Jean-Pierre Gilfaut, Saint Andre d'Apchon; André Peze, St Leger S/Roanne; Jean-Paul Ravillard; Jean-Claude Thevenet, both of Roanne, all of France

[73] Assignee: Barriquand, Roanne, France

[21] Appl. No.: 868,946

[22] Filed: May 30, 1986

[30] Foreign Application Priority Data

May 31, 1985 [FR] France ..... 85 08201

[51] Int. Cl.[4] ..... F22B 7/12

[52] U.S. Cl. ..... 122/149; 122/136 R

[58] Field of Search ..... 122/149, 136 R, 151, 122/189, 190

[56] References Cited

U.S. PATENT DOCUMENTS

| | | | |
|---|---|---|---|
| 3,329,131 | 7/1967 | Wright | 122/149 |
| 4,195,596 | 4/1980 | Scheifley et al. | 122/149 |

FOREIGN PATENT DOCUMENTS

| | | | |
|---|---|---|---|
| 884114 | 10/1971 | Canada . | |
| 1679410 | 10/1971 | Fed. Rep. of Germany . | |
| 2354906 | 5/1975 | Fed. Rep. of Germany . | |
| 1008289 | 10/1965 | United Kingdom | 122/149 |

*Primary Examiner*—Edward G. Favors

*Attorney, Agent, or Firm*—Bell, Seltzer, Park & Gibson

[57] ABSTRACT

An industrial gas operated liquid heater is provided comprising a tubular hearth or furnace a front end face of which is provided with a gas burner and a heat exchanger in which the liquid to be heated and the combustion fumes flow concurrently, the exchanger forming with said tubular hearth a unitary monobloc assembly so designed that the liquid to be heated forms, a first liquid sheet enclosing substantially the whole of the tubular hearth, except for said front end face receiving the gas burner and, in the exchanger, a plurality of second liquid sheets extending substantially parallel to the longitudinal direction of the tubular hearth and adjacent, in said exchanger, to chambers through which flow the combustion fumes issuing from the tubular hearth.

12 Claims, 6 Drawing Figures

INDUSTRIAL GAS OPERATED LIQUID HEATER

BACKGROUND OF THE INVENTION

1. Field of the Invention

The invention relates to an industrial gas operated liquid heater.

It relates more specially to such an apparatus adapted for being used for heating a process liquid, in the meaning given to this term in the engineering field, that is to say a liquid containing specific products used during a process for manufacturing or producing or transforming materials.

2. Description of the Prior Art

Installations are already known for heating a process liquid, for example the dyeing bath of an autoclave, which uses a vapor circuit. In such installations, the heating efficiency of the dyeing operation is relatively low, generally of the order of 60% with respect to the LHV, (low heat value) of the fuel, so that these installations are not entirely satisfactory from the economic point of view.

A boiler is also known, for example from DE-A-No. 2 354 906, comprising a tubular hearth or furnace a front end face of which is provided with a burner and a heat exchanger in which flow the liquid to be heated and the combustion fumes, the liquid to be heated forming a liquid sheet which encloses substantially the whole tubular hearth, except for the front end face receiving the burner.

Such a boiler, which is not intended to heat a process liquid, on the one hand, which does not state, on the other hand, if the burner which it comprises is a gas burner, does not aim at obtaining a high efficiency. It is known, in fact, that for heating systems comprising a fuel oil burner the combustion gases are not appreciably cooled so as not to reach the dew point of the fumes in order to avoid the formation of sulphuric acid likely to attack the metal walls of the apparatus, because of the presence of impurities in the fuel, whereas in systems comprising a gas burner recovery of the heat from the fumes is taken as far as possible.

Furthermore, the above referred document does not provide easy dismantling of the boiler for possible cleaning of the process liquid circuit.

To overcome these drawbacks of known installations, applicants provide an apparatus for heating a process liquid allowing a high efficiency to be obtained, not only as regards the liquid heater itself but also its application to a particular process, for example in the food industry field, or in the textile industry field while being as simple as possible to use, particularly as regards the easiness of cleaning, this factor being of particular importance when the liquid is a process liquid used in the food industry or textile industry fields.

It is a general object of the invention to provide an apparatus which allows a process liquid to be heated without intermediate heat carrying fluid and which allows the temperature of said liquid contained in a tank or in an autoclave to be raised up to values of the order of or greater than 130° C., the rate or rates of temperature rise being adjustable at will depending on the desiderata of practice.

It is also an object of the invention to provide such an apparatus which, while being compact, supplies sufficient power for it to be associated with other apparatus of an industrial installation comprising the liquid heater, for example an autoclave of a dyeing or bleaching installation.

It is also an object of the invention to provide such an apparatus which, by its construction as "self contained" device, may be specifically adapted to an apparatus which it is intended to equip and in the immediate vicinity of which it may be installed.

It is finally an object of the invention to provide such an apparatus which allows the installation of which it forms part to be worked similarly to what was achieved previously for known installations, in particular without it being necessary to make particular arrangements regarding the preservation of the characteristics of the process liquids used.

SUMMARY OF THE INVENTION

An industrial gas operated liquid heater in accordance with the invention comprising a tubular hearth or furnace a front end face of which is provided with a gas burner and a heat exchanger in which flow concurrently, the liquid to be heated and the combustion fumes, the exchanger forming with said tubular hearth a monobloc unitary assembly in which the liquid to be heated forms a first liquid sheet enclosing substantially the whole of the tubular hearth, except for the front end face receiving the gas burner, is characterized in that, in the exchanger, the liquid flows in a plurality of second liquid sheets directed longitudinally, substantially parallel to the direction of the tubular hearth and adjacent, in said exchanger, to chambers in which flow the combustion fumes coming from the tubular hearth or furnace.

In a particularly advantageous embodiment, the heat exchanger is of the type described in the French Patent No. 2 439 967 which is herein included by way of reference.

According to another feature of the invention, the liquid to be heated flows under pressure inside the apparatus under the action of an external pump.

For facilitating cleaning of the apparatus, the tubular hearth and the exchanger are connected together on the front face comprising the gas burner by flanges assembled together with readily removable means.

In a preferred embodiment, the tube itself of the tubular hearth and the heat exchanging means of the exchanger are welded to one of said flanges at one of their ends, on the one hand, and are united together at their other end remote from the one carrying the burner, on the other hand.

A separation plate extending over the greatest part of the length of the exchanger is located between the tubular hearth and said exchanger.

In a preferred embodiment, one and the same external shroud surrounds both the heat exchanging means of the exchanger and the greatest part of the periphery of the tubular hearth.

In such an embodiment also the tubular hearth, the external shroud and the channels in which the liquid flows through the exchanger are shaped so as to have neither sharp edge, nor retention point, nor obstacle nor singular pressure loss point likely to give rise to zones in which the liquid flows less well.

The walls defining the liquid sheet enclosing substantially the whole of the tubular hearth, on the one hand, and those defining the liquid sheets in the heat exchanger on the other, are advantageously made from a material appropriate to the physico-chemical nature of the liquid to be heated, such as stainless steel or the like.

The invention also relates to a gas operated liquid heating installation, particularly for the textile industry or the food industry, comprising a liquid heater such as defined above, means for causing the liquid to flow in the liquid heater, means for controlling and regulating the gas burner and means for controlling the flow rate of the liquid in the liquid heater.

In one embodiment of such an installation, the liquid enters the liquid heater through a pipe communicating with the liquid sheet enclosing substantially the whole of the tubular hearth and leaves through a pipe communicating with the heat exchanger.

In another embodiment, the liquid enters the liquid heater through the pipe communicating with the heat exchanger and leaves the liquid heater through the pipe communicating with said liquid sheet.

BRIEF DESCRIPTION OF THE DRAWINGS

The invention will be better understood from the following description, given by way of example, with reference to the accompanying drawings in which.

DESCRIPTION OF THE PREFERRED EMBODIMENT

Figure 1:
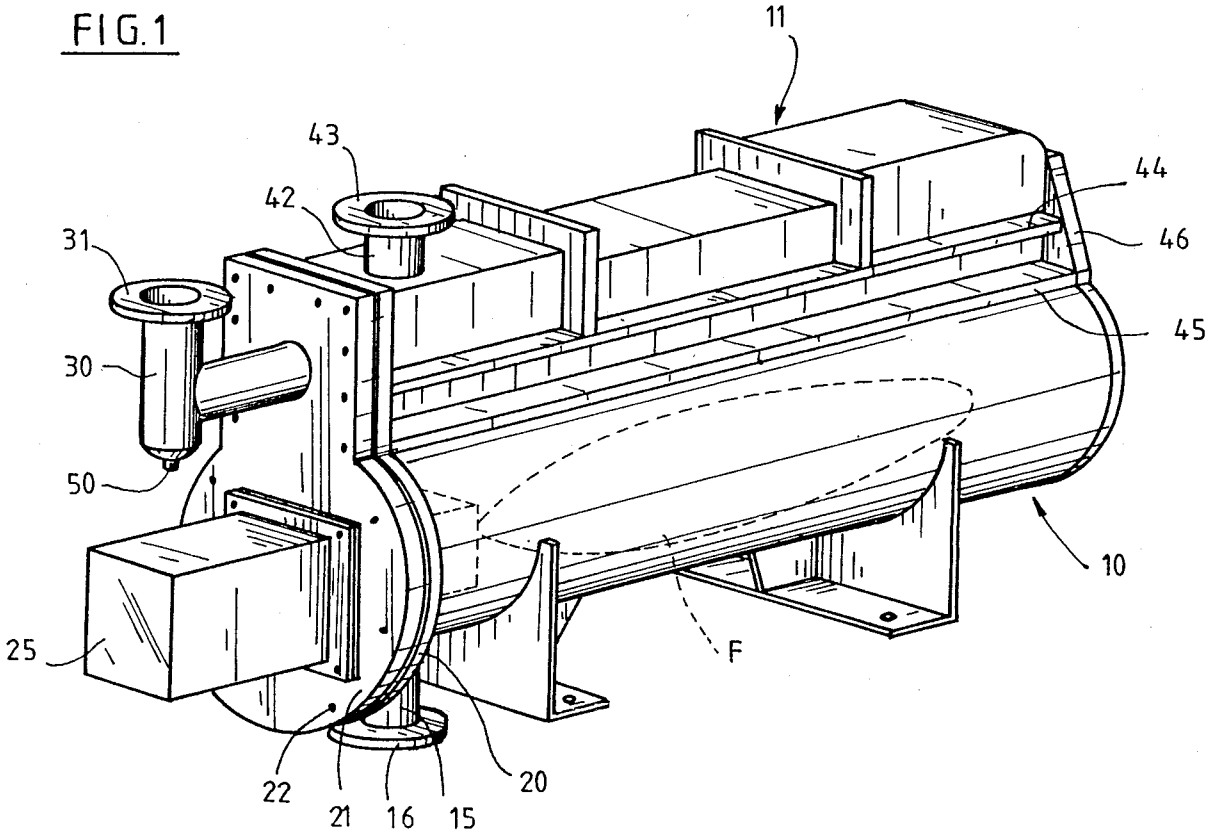
FIG. 1 is a perspective view of an industrial gas liquid heating apparatus in accordance with the invention.
Figure 2:
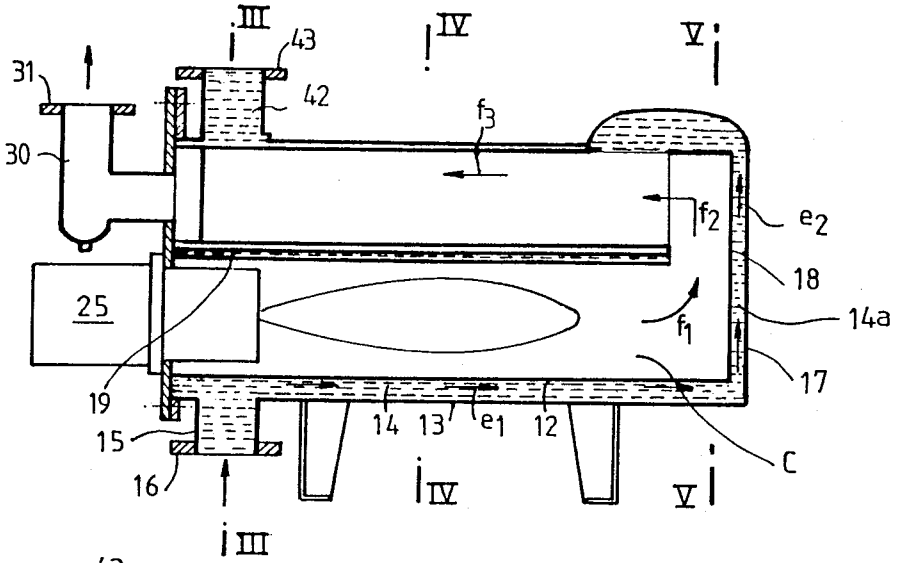
FIG. 2 is a schematical view in longitudinal section.
Figure 5:
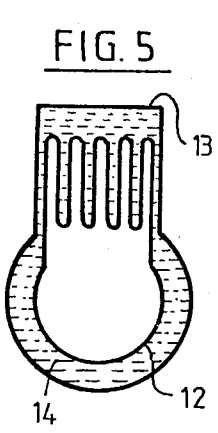
FIG. 5 is a sectional view through line V—V of FIG. 2.
Figure 4:
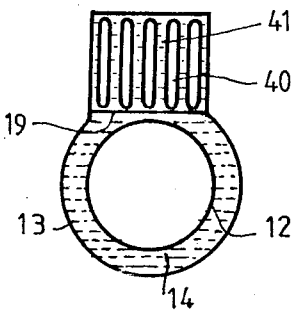
FIG. 4 es a sectional view through line IV—IV of FIG. 2.
Figure 3:
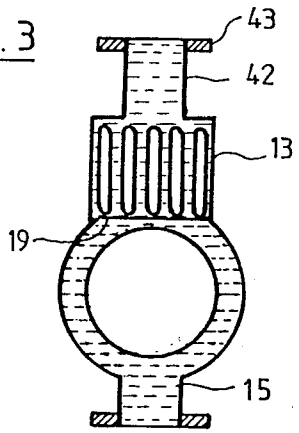
FIG. 3 is a sectional view through line III—III of FIG. 2.

Reference is first made to FIG. 1 which shows the general structure of an industrial gas operated liquid heater in accordance with the invention.

It comprises a tubular hearth or furnace 10 and a heat exchanger 11 forming with said tubular hearth a unitary one piece assembly.

As can be seen in FIGS. 2 to 5, the tubular hearth 10 comprises a tube 12, preferably made of stainless steel, closed at one of its ends by a front wall 18 and inside which is provided a flame F by means of a burner 25 fixed to the other front face which thus defines with the wall 18 and tube 12 a cylindrical combustion chamber C.

Tube 12 is surrounded, over the largest part of its periphery, by an external shroud 13 which forms with the tube 12 and therealong an annular space 14, said space being extended over the front wall 18—between this latter and a face 17 of the shroud 13 which is parallel thereto—by a space 14*a*, the spaces 14 and 14*a* defining a first sheet through which flows the process liquid which the apparatus is intended to heat.

In the vicinity of the front face comprising the burner, a pipe 15, with connecting flange 16, is welded to the shroud 13 so that there is no obstacle to the flow of the liquid likely to cause zones of stagnation or retention of said liquid which enters or leaves the apparatus through said pipe.

The same is true moreover over the whole length and thickness of the liquid sheet so as not to cause, locally, overheating of the liquid likely to impair its characteristics.

To this end, in accordance with the invention, the tubular hearth, external shroud and the channels through which the liquid flows through the exchanger 11 are formed so that there is no location having sharp edges, retention points, obstacles or singular pressure loss points likely to cause zones in which the liquid flows less well and, therefore, excessive heating leading to a deterioration of its characteristics.

Furthermore, the walls defining the liquid sheet about the tubular hearth and the flow channels through the exchanger are advantageously polished and the path of the liquid laid out so as not to cause any drop in the flow rate which, causing overheating, could damage the thermosensitive products contained in the process liquid.

In accordance with the invention, also, the tubular hearth 10 and the exchanger 11 are united together into a one piece unitary assembly with interpositioning therebetween of a metal plate 19 which extends over the greatest part of the length of the exchanger (FIGS. 2 to 5), said metal sheet defining with the tube 12 the upper part—in the drawings—of the annular space 14 through which the liquid flows in the apparatus.

In the embodiment described and shown, assembly is made, on the one hand, in the vicinity of wall 18 and, on the other hand, at the front end of the apparatus comprising the gas burner by means of two flanges 20 and 21 connected side by side and each shaped externally with a circular part having a diameter slightly greater than that of the tubular hearth and a radial part whose dimensions are somewhat larger than the cross section of the exchanger 11. Flange 21, to which tube 12 and the heat exchanging means of the heat exchanger 11 are welded, also supports the burner 25. Said flange is joined to flange 20 welded to the shroud 13 by removable fixing means 22, for example nuts and bolts, which allow said flange to be readily dismantled with respect to flange 20 so as to give access to the inner space inside the external shroud 13 as well as to the inside of exchanger 11.

To give the assembly sufficient mechanical strength, more specially because of the fact that the apparatus may operate under pressure, the unitary monobloc assembly formed by the tubular hearth 10 and the exchanger 11 is made more rigid by means of longitudinal reinforcements such as 44 and 45 or else by means of an end plate such as 46 aligned with the front face of the apparatus opposite that comprising the burner 25.

In the embodiment described and shown, and without this indication having any limitative character whatsoever, the heat exchanger 11 is advantageously of the type described in French Pat. No. 2 439 967, in particular of the type illustrated in FIG. 6 of this patent.

Such an exchanger is characterized in that it comprises channels 41 of an elongate cross section, not circular, for the passage of the liquid and a stack of chambers 40 with non circular cross section, adjacent said channels and provided for the passage of the combustion fumes coming from the tubular hearth.

Said fumes, whose path is shown by the arrows $f_1$, $f_2$, $f_3$ are discharged, after passing through the exchanger 11, through a discharge duct 30,—comprising a means for extracting the condensates 50, FIG. 1—and whose free end is provided with a flange 31 for connection to a chimney communicating with the atmosphere.

The flow of the fumes in exchanger 11 takes place cocurrent or countercurrentwise with respect to that of the liquid to be heated which is caused to flow by means of a pump, not shown.

Shroud 13, which surrounds the greatest part of tube 12, also encloses the exchanger tube stack 11. On said shroud, and substantially opposite pipe 15, is welded a pipe 42 with flange 43 for conveying the liquid into or out of the exchanger.

In the case where liquid intake takes place through pipe 15, the liquid moves in the form of a first liquid sheet between the wall of the tubular hearth 12 and the external shroud 13, as shown by the arrow $e_1$ and the arrow $e_2$ between the front wall 18 of the tubular hearth and the front wall which is parallel thereto of the external shroud, then penetrates into exchanger 11 from which it leaves through pipe 42 comprising the connection flange 43 to the rest of the installation equipped with the liquid heater.

When, in another method of use, the liquid to be heated enters the liquid heater through the pipe 42, it passes first of all through the exchanger 11 then, travelling over a path which is the reverse of the one defined above, leaves the apparatus through pipe 15.

An apparatus in accordance with the invention is particularly suitable for heating process liquids used in the food or pharmaceutical industries, for example the liquid of a sterilizing autoclave, or in the textile industry, whether it is a question of bleaching baths or else, in particular, dyeing baths.

Figure 6:
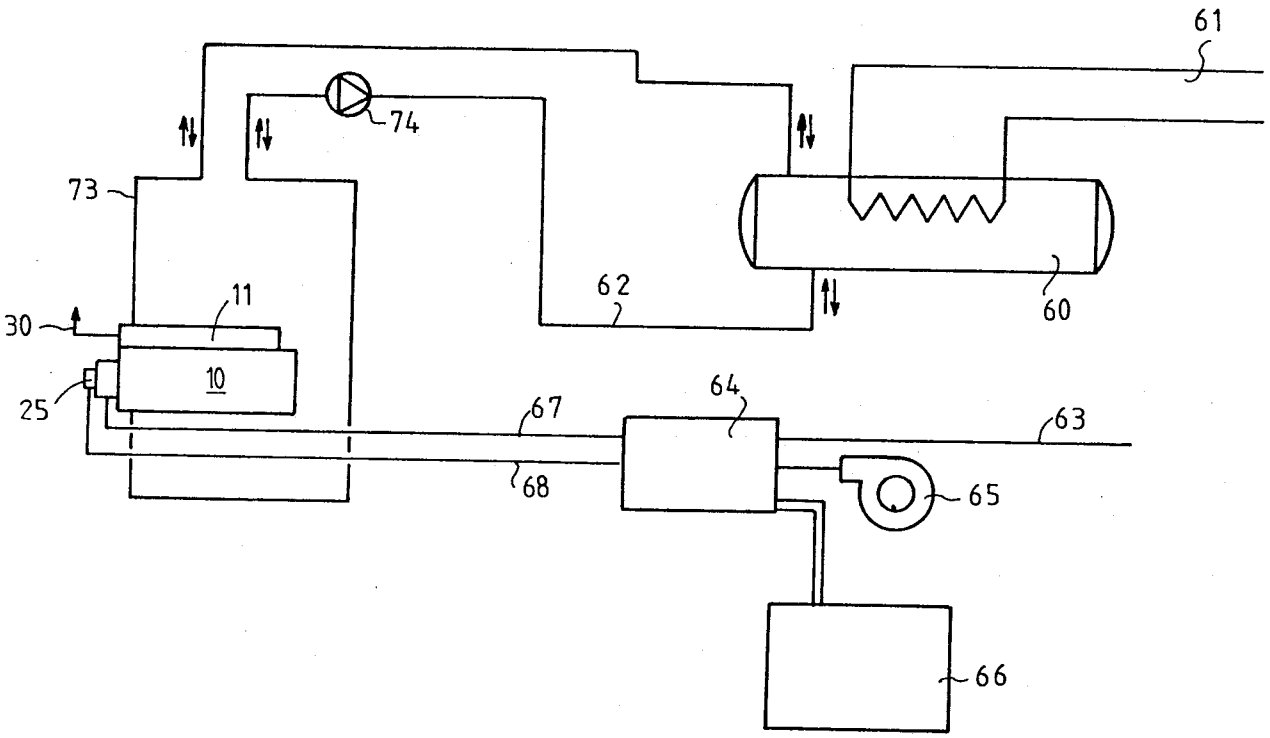
FIG. 6 is a schematical view of an example of a dyeing installation comprising an apparatus according to the invention.

In such an application, the liquid heater of the invention may be advantageously used for heating the dyeing bath contained in the autoclave 60, FIG. 6, with which are associated a cooling circuit 61 and a heating circuit 62 provided with an apparatus of the invention.

This latter is fed from a gas line 63 connected to an air-gas supply plate 64 to which is joined a combustive air fan 65 and which is controlled from a programmer 66 for controlling the burner 25 connected to plate 64 through gas and air intake lines 67 and 68, respectively.

The dyeing bath from the autoclave 60 is fed into the liquid heater of the invention by means of a pump 72. The outlet from the liquid heater, through a circuit 73, again brings the bath into the autoclave 60.

The structure of the apparatus such as defined above allows the bath to be heated without difficulty, even when it is charged with fibrils of the material or materials to be dyed.

Furthermore, and because of its "integrated" structure, it is particularly well suited to the use of short baths, with low or very low bath ratios, as is required at the present time in modern dyeing plants.

In an installation such as described above, excellent results have been obtained in so far as the instantaneous thermal efficiency of the apparatus is concerned, which is between 89 and 95% LHV, depending on the temperature of the dyeing liquid.

For a dyeing cycle, that is to say the whole of a process comprising temperature rises at well defined rates, separated by intermediate level stretches and cooling phases the main heating efficiency was of the order of 93 to 94% LHV for maximum bath temperatures of the order of 130° C.

These good results are due in particular to the fact that the temperature of the outgoing combustion fumes is of the order of a few degrees only greater than the outgoing temperature of the liquid, these results being attained for flow rates of processed liquids varying in wide ratios, of the order of 1:3.

A comparison of the results obtained with those of an installation such as illustrated above but comprising heating of the dyeing bath of the autoclave by means of a vapor circuit has shown that savings of the order of 35 % at least were achieved using an apparatus of the invention with respect to a usual vapor heating installation.

What is claimed is:

1. An industrial gas operated liquid heater comprising a tubular hearth, a gas burner connected to a front end face of said hearth so that the hearth defines a first path of travel for combustion fumes emanating from said burner, a heat exchanger connected to said tubular hearth and forming therewith a one-piece unitary assembly, said heat exchanger comprising a plurality of spaced apart chambers extending longitudinally adjacent to said hearth and communicatively connected thereto so as to provide a plurality of discrete second paths of travel for combustion fumes issuing from the tubular hearth while defining between adjacent chambers a plurality of channels for passage of liquid in heat exchanging relation to said chambers, a shroud having portions surrounding said tubular hearth in spaced relation thereto so as to provide an annular space substantially enclosing said tubular hearth for accomodating liquid flow therethrough, said shroud additionally having portions surrounding said plurality of chambers and cooperating therewith to define the paths of liquid flow whereby liquids introduced into the heater flow through both the annular space surrounding the hearth and through said plurality channels of the heat exchanger in heat exchanging relation to the combustion fumes flowing through the hearth and through the chambers of the heat exchanger.

2. The liquid heater as claimed in claim 1, including means for removably mounting the one-piece unitary assembly of said hearth and said heat exchanger within said shroud to permit access to the tubular hearth and the heat exchanger for cleaning thereof.

3. The liquid heater as claimed in claim 2 wherein said means for removably mounting the one-piece unitary assembly comprises a flange, and wherein one end of said tubular hearth and one end of said heat exchanger are welded to said flange.

4. The liquid heater as claimed in claim 1 wherein said tubular hearth and said heat exchanger are fabricated from a material which is resistant to the adverse effects from the physicochemical nature of the liquid to be heated in said heater.

5. The liquid heater as claimed in claim 4 wherein said material comprises stainless steel.

6. The liquid heater as claimed in claim 1 comprising liquid inlet and outlet pipes welded to said shroud.

7. The liquid heater as claimed in claim 1, comprising a separation plate extending over the greatest part of the length of said exchanger and interposed between the tubular hearth and said exchanger.

8. The liquid heater as claimed in claim 1, wherein the tubular hearth, the external shroud and the channels through which the liquid flows through the exchanger are formed so as to have neither sharp edge, nor retention point, nor obstacle nor singular pressure loss point likely to cause zones in which the liquid flows less well.

9. The liquid heater as claimed in claim 1, wherein the heat exchanger comprises elongate cross section channels for the passage of said liquid and non circular adjacent channels for the passage of the combustion fumes issuing from the tubular hearth.

10. A gas operated liquid heating installation, for the textile industry and the food industry, comprising a liquid heater as claimed in claim 1, a means for causing the liquid to flow through the liquid heater, means for controlling and regulating the gas burner and means for controlling the flow rate of the liquid through the liquid heater.

11. The gas operated liquid heating installation as claimed in claim 10, wherein the liquid enters the liquid heater through a pipe communicating with the annular space enclosing the tubular hearth and leaves through a pipe communicating with the heat exchanger so as to flow co-current with the flow of combustion fumes.

12. The gas operated liquid heating installation as claimed in claim 10, wherein the liquid enters the liquid heater through a pipe communicating with the heat exchanger and leaves through a pipe communicating with the annular space enclosing the tubular hearth so as to flow countercurrent with the flow of combustion fumes from said burner.

* * * * *